US009868910B2

(12) United States Patent
LaChance et al.

(10) Patent No.: US 9,868,910 B2
(45) Date of Patent: Jan. 16, 2018

(54) PROCESS FOR MANAGING HYDRATE AND WAX DEPOSITION IN HYDROCARBON PIPELINES

(71) Applicants: Jason W. LaChance, Magnolia, TX (US); Michael G. Starkey, Ashtead (GB); William E. Bond, Spring, TX (US)

(72) Inventors: Jason W. LaChance, Magnolia, TX (US); Michael G. Starkey, Ashtead (GB); William E. Bond, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/137,471

(22) Filed: Apr. 25, 2016

(65) Prior Publication Data

US 2016/0355740 A1 Dec. 8, 2016

Related U.S. Application Data

(60) Provisional application No. 62/171,119, filed on Jun. 4, 2015.

(51) Int. Cl.
*C10G 31/06* (2006.01)
*C10G 29/00* (2006.01)
(Continued)

(52) U.S. Cl.
CPC ..... *C10G 31/06* (2013.01); *C10G 29/00* (2013.01); *C10L 3/108* (2013.01); *E21B 43/01* (2013.01); *C10L 2290/06* (2013.01)

(58) Field of Classification Search
CPC ..... C10G 31/06; C10G 29/00; E21B 43/01; C10L 3/101; C10L 3/106; C10L 3/107; C10L 3/108; C10L 2270/10
See application file for complete search history.

(56) References Cited

U.S. PATENT DOCUMENTS 6,656,366 B1 12/2003 Fung et al.
6,774,276 B1 8/2004 Lund et al.
(Continued)

FOREIGN PATENT DOCUMENTS

WO WO 00/25062 5/2000
WO WO 2009/058027 5/2009
WO WO 2014/183165 A1 * 11/2014 ..... C10L 3/10

OTHER PUBLICATIONS

Dawe, R.A.et al. (2003). Hydrate Technology for Transporting Natural Gas, 16, 11-18.*
(Continued)

*Primary Examiner* — Brian McCaig
(74) *Attorney, Agent, or Firm* — ExxonMobil Upstream Research Company—Law Department

(57) ABSTRACT

A process for managing hydrates and hydrocarbon-based solids in a hydrocarbon stream. The process includes: introducing the hydrocarbon stream into an inlet of a system comprising at least a first cold flow reactor and a second cold flow reactor, each cold flow reactor comprising a heat exchanger and at least one static mixer; directing at least a portion of the hydrocarbon stream to the first cold flow reactor; cooling the portion of the hydrocarbon stream directed to the first cold flow reactor to a temperature less than the hydrate formation temperature, the temperature effective to substantially complete hydrate formation upon exiting the system to form a hydrate and hydrocarbon-based solids managed hydrocarbon stream; directing a lesser portion of the hydrocarbon stream to the second cold flow reactor; and remediating the second cold flow reactor by removing hydrate or hydrocarbon-based solids formed on internal surfaces of the second cold flow reactor. A remediable system for managing hydrates and hydrocarbon-based solids in a hydrocarbon stream is also described.

7 Claims, 5 Drawing Sheets

(51) Int. Cl.
*E21B 43/01* (2006.01)
*C10L 3/10* (2006.01)

(56) References Cited

U.S. PATENT DOCUMENTS

| | | | | |
|---|---|---|---|---|
| 7,008,466 | B2 | 3/2006 | Collins | |
| 7,261,810 | B2 | 8/2007 | Argo et al. | |
| 8,033,336 | B2 | 10/2011 | Benson | |
| 8,256,519 | B2 | 9/2012 | Friedemann | |
| 8,436,219 | B2 | 5/2013 | Talley et al. | |
| 8,602,113 | B2 | 12/2013 | Jin et al. | |
| 2002/0120172 | A1 | 8/2002 | Waycuilis et al. | |
| 2004/0129609 | A1 | 7/2004 | Argo et al. | |
| 2009/0078406 | A1* | 3/2009 | Talley ..... | B01F 5/061<br>166/177.3 |
| 2010/0012325 | A1 | 1/2010 | Friedemann | |

OTHER PUBLICATIONS

LaChance, L.D. et al., "Formation of Hydrate Slurries in a Once-Through Operation," *Energy Fuels* 26, pp. 4059-4066 (2012).

* cited by examiner

PROCESS FOR MANAGING HYDRATE AND WAX DEPOSITION IN HYDROCARBON PIPELINES

CROSS-REFERENCE TO RELATED APPLICATION

This application claims the priority benefit of U.S. Provisional Patent Application No. 62/171,119, filed Jun. 4, 2015, entitled PROCESS FOR MANAGING HYDRATE AND WAX DEPOSITION IN HYDROCARBON PIPELINES, the entirety of which is incorporated by reference herein.

FIELD

The present disclosure is directed to minimizing the problems associated with hydrate and other solids deposition in subsea oil and gas production operations.

BACKGROUND

In subsea hydrocarbon production systems, wellstream fluids are transported via pipeline back to a topsides production facility. Typically, flow assurance strategies are employed that prevent the formation of hydrates and prevent or mitigate the formation of wax deposits in the pipeline. For transportation of the hydrocarbons in subsea pipelines that are more than about 100 kilometers long, the currently available flow assurance strategies such as continuous injection of chemical inhibitors or pipeline heating can be impractical and uneconomic to implement.

An alternative strategy is to purposely cause the hydrates and wax to form subsea in such a manner that a flowable slurry is formed that does not block flow in the pipeline. This alternative strategy is known in the industry as "cold flow." While efforts have demonstrated that sudden plugging may be avoided with cold flow, hydrate deposition in the form of a hydrate film on the pipe wall and mixer surfaces of a cold flow reactor can result in gradual constriction of the flow area and an unacceptable increase in pressure drop over extended periods of time. Conventional flow loop testing to date within the industry has not been able to assess this effect. However, recent efforts have shown this effect to be detrimental to the cold flow process.

Thus, it is desired to develop a technique to reduce or prevent hydrate and/or other solids deposition on the pipe walls thus improving the cold flow process.

SUMMARY

In one aspect, disclosed herein is a process for managing hydrates and hydrocarbon-based solids in a hydrocarbon stream, the process includes: introducing the hydrocarbon stream into an inlet of a system comprising at least a first cold flow reactor and a second cold flow reactor, each cold flow reactor comprising a heat exchanger and at least one static mixer; directing at least a portion of the hydrocarbon stream to the first cold flow reactor; cooling the portion of the hydrocarbon stream directed to the first cold flow reactor to a temperature less than the hydrate formation temperature, the temperature and residence time within the reactor effective to substantially complete hydrate formation upon exiting the system to form a hydrate and hydrocarbon-based solids managed hydrocarbon stream; directing a lesser portion of the hydrocarbon stream to the second cold flow reactor; and remediating the second cold flow reactor by removing hydrate or hydrocarbon-based solids formed on internal surfaces of the second cold flow reactor.

In certain embodiments, hydrate or hydrocarbon-based solids are removed by introducing chemicals into the lesser portion of the hydrocarbon stream.

In certain embodiments, hydrate or hydrocarbon-based solids are removed by heating the external surfaces of the second cold flow reactor.

In certain embodiments, the process further includes forming a remediation slipstream comprising removed hydrate or hydrocarbon-based solids. In certain embodiments, the process further includes returning the remediation slipstream to the inlet of the system to recycle the fluids and prevent "non-cold flow, remediated" fluids from entering the pipeline downstream of the reactors.

In certain embodiments, the second cold flow reactor has been substantially remediated.

In certain embodiments, the process further includes: directing at least a portion of the hydrocarbon stream to the second cold flow reactor; cooling the portion of the hydrocarbon stream directed to the second cold flow reactor to a temperature less than the hydrate formation temperature, the temperature and residence time within the reactor effective to substantially complete hydrate formation upon exiting the system to form a hydrate and hydrocarbon-based solids managed hydrocarbon stream; directing a lesser portion of the hydrocarbon stream to the first cold flow reactor; and remediating the first cold flow reactor by removing hydrate or hydrocarbon-based solids formed on internal surfaces of the first cold flow reactor.

In certain embodiments, the process further includes forming a remediation slipstream from the cold flow reactor undergoing remediation comprising removed hydrate or hydrocarbon-based solids.

In certain embodiments, the process further includes returning the remediation slipstream to the inlet of the system to recycle the fluids and prevent "non-cold flow, remediated" fluids from entering the pipeline downstream of the reactors.

In another aspect, disclosed is a remediable system for managing hydrates and hydrocarbon-based solids in a hydrocarbon stream. The system includes a first cold flow reactor comprising an inlet for receiving at least a portion of the hydrocarbon stream, an outlet, a heat exchanger, and at least one static mixer; a second cold flow reactor comprising an inlet for receiving at least a portion of the hydrocarbon stream, an outlet, a heat exchanger, and at least one static mixer; a first mechanism for providing a lesser portion of the hydrocarbon stream to the first cold flow reactor or the second cold flow reactor and placing the cold flow reactor receiving the lesser portion of the hydrocarbon stream in a remediation mode; and a second mechanism for placing the outlet of the cold flow reactor receiving the lesser portion of the hydrocarbon stream in fluid communication with the hydrocarbon stream upstream of the first cold flow reactor and the second cold flow reactor.

In certain embodiments, the heat exchanger of the first cold flow reactor, or the heat exchanger of the second cold flow reactor, cools the portion of the hydrocarbon stream directed thereto to a temperature less than the hydrate formation temperature when not in remediation mode, the temperature effective to substantially complete hydrate formation upon exiting the system.

In certain embodiments, for each cold flow reactor, the static mixer is positioned upstream of the heat exchanger and in fluid communication therewith.

In certain embodiments, for each cold flow reactor, a second static mixer is positioned downstream of the heat exchanger and in fluid communication therewith.

In certain embodiments, for each cold flow reactor, the static mixer is positioned downstream of the heat exchanger and in fluid communication therewith.

In certain embodiments, each cold flow reactor further includes a flow line for delivering chemicals for remediation of hydrate or hydrocarbon-based solids.

In certain embodiments, each cold flow reactor further comprises a heater for remediation of hydrate or hydrocarbon-based solids.

In certain embodiments, the system further includes a third cold flow reactor, the third cold flow reactor comprising an inlet for receiving at least a portion of the hydrocarbon stream, an outlet, a heat exchanger, and at least one static mixer, wherein the first mechanism is structured and arranged to provide a lesser portion of the hydrocarbon stream to the first cold flow reactor or the second cold flow reactor or the third cold flow reactor and placing that cold flow reactor receiving the lesser portion of the hydrocarbon stream in a remediation mode.

In certain embodiments, the second mechanism is structured and arranged to place the outlet of the cold flow reactor receiving the lesser portion of the hydrocarbon stream in fluid communication with the suction side of the pump.

DETAILED DESCRIPTION

FIGS. 1A-4 provide illustrative, non-exclusive examples of systems and methods for making a cold flow slurry that provide for continuous production flow, according to the present disclosure, together with elements that may include, be associated with, be operatively attached to, and/or utilize such systems and methods.

In FIGS. 1A-4, like numerals denote like or similar structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are illustrated. However, a given embodiment is not required to include all structures and/or features that are illustrated in the figures, and any suitable number of such structures and/or features may be omitted from a given embodiment without departing from the scope of the present disclosure.

Figure 1A:
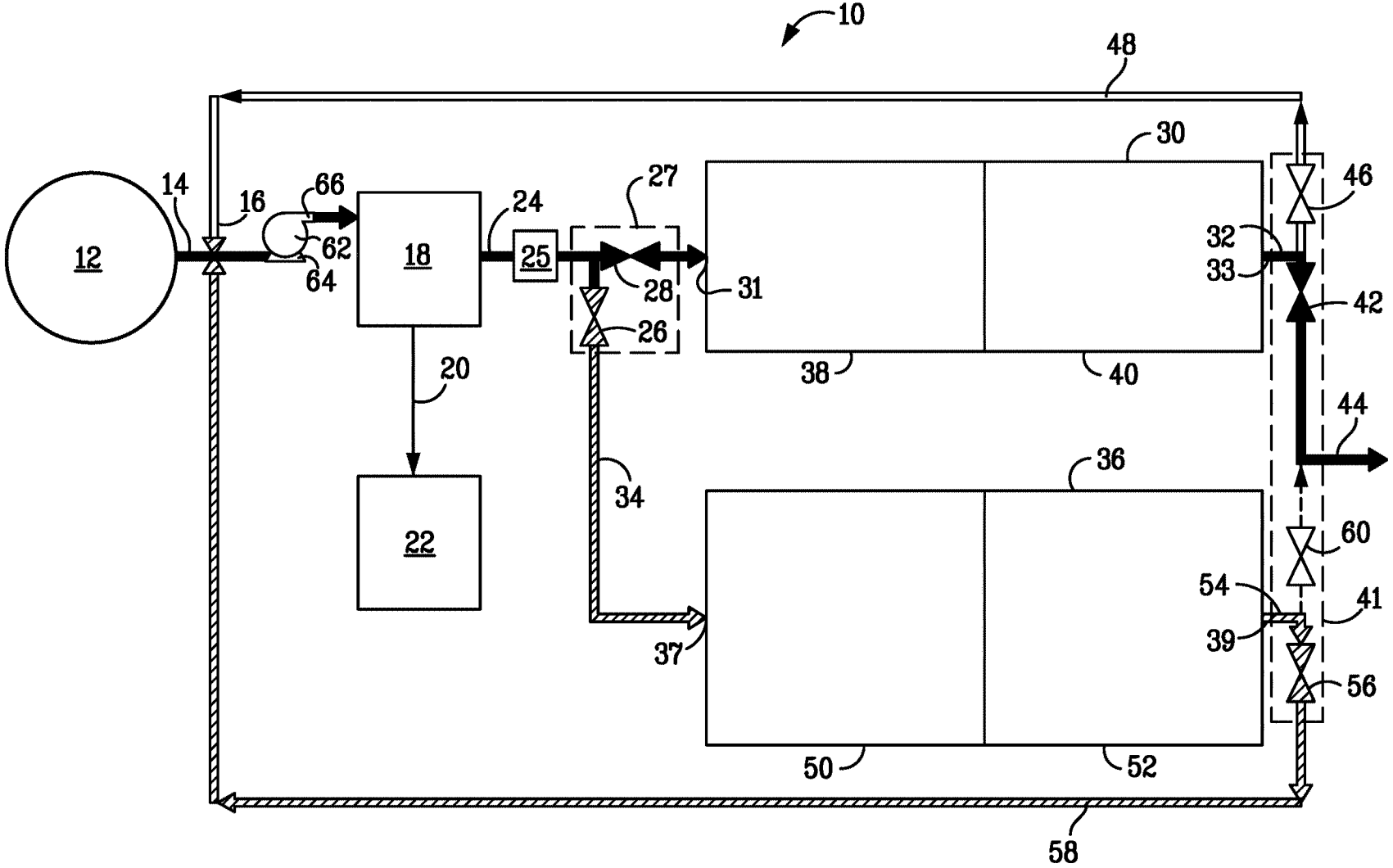
FIG. 1A presents a schematic diagram of an embodiment of a remediable system for managing hydrates and hydrocarbon-based solids in a hydrocarbon stream, in accordance herewith.
Figure 1B:
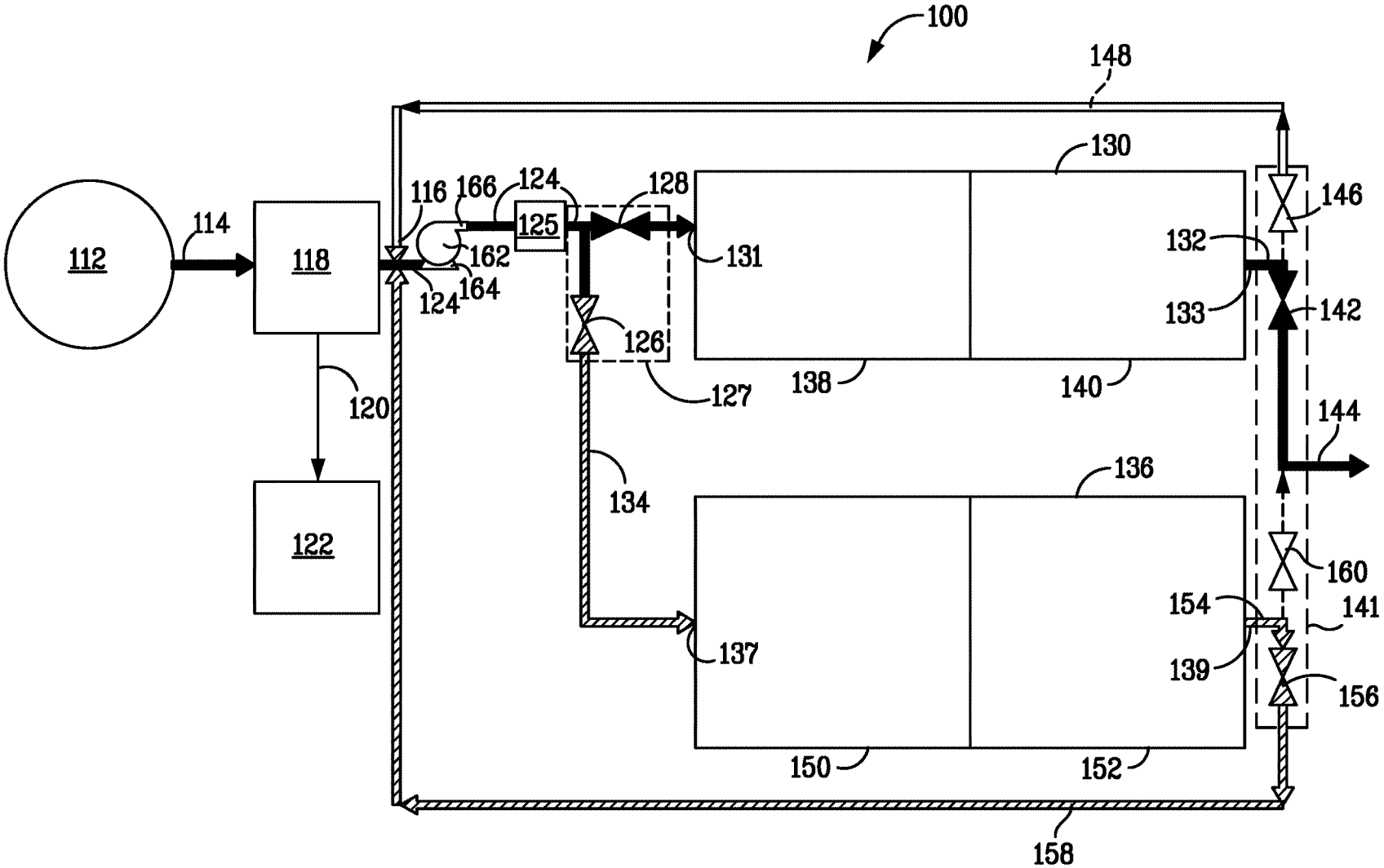
FIG. 1B presents a schematic diagram of another embodiment of a remediable system for managing hydrates and hydrocarbon-based solids in a hydrocarbon stream, in accordance herewith.
Figure 2:
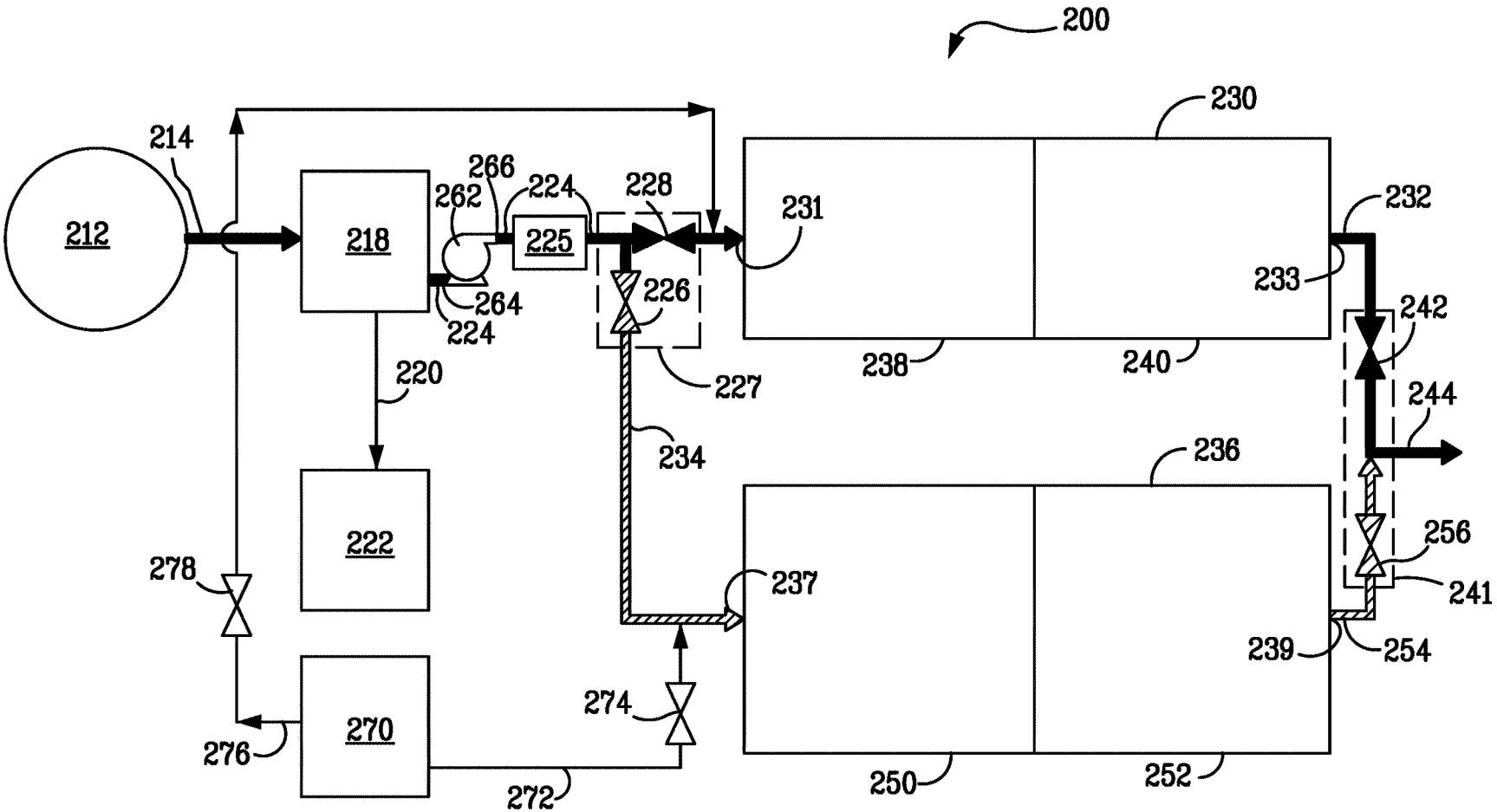
FIG. 2 presents a schematic diagram of yet another embodiment of a remediable system for managing hydrates and hydrocarbon-based solids in a hydrocarbon stream, in accordance herewith.

In FIGS. 1A, 1B, and 2, heavy, solid, black lines represent fluid pathways that are configured to have substantial flow through them. Crosshatched lines represent fluid pathways that are configured to have a lesser flow, such as a choked flow or, optionally, no flow through them. Parallel lines indicate fluid pathways that are configured to have no flow through them. Paired triangles represent valves, with filled-in triangles configured in a substantially open to fully open condition, crosshatched triangles configured to be partially closed or, optionally, fully closed, and unfilled triangles representing fully closed valves.

Referring now to FIG. 1A, one embodiment of a remediable system 10 for managing hydrates and hydrocarbon-based solids in a hydrocarbon stream is presented. As shown, production from an undersea production field 12 flows through flow line 14, through valve 16 to the suction side 64 of pump 62. The discharge side 66 of pump 62 is fed to a separation facility 18, which may be configured to remove water via flow line 20 to a water injection facility 22. After separation, a flow containing hydrocarbons (in gaseous, liquid, suspended solid forms, or any combination thereof) and water passes through flow line 24, to a first mechanism 27 for dividing the flow between inlet 31 of first cold flow reactor 30 and inlet 37 of a second cold flow reactor 36. In certain embodiments, the volume of flow sent to the first cold flow reactor 30 may range from 0 vol. % to 100 vol. %, and the volume of flow sent to the second cold flow reactor 36 may range from 100 vol. % to 0 vol. %.

In certain embodiments, the first mechanism 27 provides a lesser portion of the hydrocarbon stream to the first cold flow reactor 30 or the second cold flow reactor 36, the cold flow reactor receiving the lesser portion of the hydrocarbon stream placed in a remediation mode. In certain embodiments, the first mechanism 27 includes a first valve 26, and a second valve 28. As shown in FIG. 1A, the first valve 26 and the second valve 28 are configured so that cold flow reactor 30 is on-line and receives a major portion (greater than 50 volume percent (vol. %)) of the flow, with cold flow reactor 36 placed off-line, receiving a minor portion (less than 50 vol. %) of the flow through flow line 34.

In certain embodiments, a second mechanism 41 is provided for placing outlet 33 or 39 of the cold flow reactor 30 or 36 (whichever is receiving the lesser portion of the hydrocarbon stream) in fluid communication with the suction side 64 of pump 62. As shown, second mechanism 41 may include valves 42, 46, 56, and 60.

In operation, the flow to the on-line cold flow reactor 30 is emulsified by a static mixer 38 and cooled by a heat exchanger 40 of the cold flow reactor 30, to form a hydrate slurry (when water and gas are present), which is sent through flow line 32 and valve 42 of the second mechanism 41, to the production flow line 44, rather than through valve 46 of the second mechanism 41 and return flow jumper 48.

The flow to the off-line cold flow reactor 36 may be choked or terminated at valve 26 of the first mechanism 27 and remediation measures implemented. In some embodiments, heat may be applied to the external surfaces of the static mixer 50 and heat exchanger 52 of off-line cold flow reactor 36. As shown in FIG. 1A, in some embodiments, the flow containing the remediation products may be returned through flow line 54 through valve 56 of the second mechanism 41 and return flow jumper 58, to the suction side 64 of the pump 62, upstream of the separation facility 18 via valve 16.

When the cold flow reactor 36 has been remediated, it can be switched over to on-line mode, and serve as the on-line reactor. Cold flow reactor 30 can then be configured to undergo remediation. These changes are accomplished by resetting of valves 16, 26, 28, 42, 46, 56, and 60.

In one optional embodiment, the production flow from conduit 24 is first pre-cooled in heat exchanger 25 to a temperature above the wax formation temperature, so as to reduce heat loads on the heat exchangers 40 and 52 of the cold flow reactors 30 and 36. Alternatively, a pre-cooling heat exchanger can be placed in each cold flow reactor 30 and 36, prior to the flow encountering static mixer 38 and 50.

Referring now to FIG. 1B, another embodiment of a remediable system 100 for managing hydrates and hydrocarbon-based solids in a hydrocarbon stream is presented. As shown, production from an undersea production field 112 flows through flow line 114 to a separation facility 118, which may be configured to remove water via flow line 120 to a water injection facility 122. As will be described more fully below, in this embodiment, the flow containing the remediation products may be returned downstream of the separation facility 118, rather than upstream of the separation facility 118, as was the case for the FIG. 1A embodiment.

After separation, a flow containing hydrocarbons (in gaseous, liquid, suspended solid forms, or any combination thereof) and water passes through flow line 124 and valve 116 to the suction side 164 of pump 162. The discharge side 166 of pump 162 is fed to a first mechanism 127 for dividing the flow between inlet 131 of first cold flow reactor 130 and inlet 137 of a second cold flow reactor 136. In certain embodiments, the volume of flow sent to the first cold flow reactor 130 may range from 0 vol. % to 100 vol. %, and the volume of flow sent to the second cold flow reactor 136 may range from 100 vol. % to 0 vol. %.

As with the embodiment of FIG. 1A, in certain embodiments, the first mechanism 127 provides a lesser portion of the hydrocarbon stream to the first cold flow reactor 130 or the second cold flow reactor 136, the cold flow reactor receiving the lesser portion of the hydrocarbon stream placed in a remediation mode. In certain embodiments, the first mechanism 127 includes a first valve 126, and a second valve 128. As shown in FIG. 1B, the first valve 126 and the second valve 128 are configured so that cold flow reactor 130 is on-line and receives a major portion (greater than 50 vol. %) of the flow, with cold flow reactor 136 placed off-line, receiving a minor portion (less than 50 vol. %) of the flow through flow line 134.

In certain embodiments, a second mechanism 141 is provided for placing outlet 133 or 139 of the cold flow reactor 130 or 136 (whichever is receiving the lesser portion of the hydrocarbon stream) in fluid communication with the suction side 164 of pump 162. As shown, second mechanism 141 may include valves 142, 146, 156, and 160.

In operation, the flow to the on-line cold flow reactor 130 is emulsified by a static mixer 138 and cooled by a heat exchanger 140 of the cold flow reactor 130, to form a hydrate slurry (when water and gas are present), which is sent through flow line 132 and valve 142 of the second mechanism 141, to the production flow line 144, rather than through valve 146 of the second mechanism 141 and return flow jumper 148.

The flow to the off-line cold flow reactor 136 may be choked or terminated at valve 126 of the first mechanism 127 and remediation measures implemented. In some embodiments, heat may be applied to the external surfaces of the static mixer 150 and heat exchanger 152 of off-line cold flow reactor 136. As shown in FIG. 1B, in some embodiments, the flow containing the remediation products may be returned through flow line 154 through valve 156 of the second mechanism 141 and return flow jumper 158, to the suction side 164 of the pump 162, downstream of the separation facility 118 via valve 116.

When the cold flow reactor 136 has been remediated, it can be switched over to on-line mode, and serve as the on-line reactor. Cold flow reactor 130 can then be configured to undergo remediation. These changes are accomplished by resetting of valves 116, 126, 128, 142, 146, 156, and 160.

In an optional embodiment, the production flow from conduit 124 is first pre-cooled in heat exchanger 125 to a temperature above the wax formation temperature, so as to reduce heat loads on the heat exchangers 140 and 152 of the cold flow reactors 130 and 136. Alternatively, a pre-cooling heat exchanger can be placed in each cold flow reactor 130 and 136, prior to the flow encountering static mixer 138 and 150.

In some embodiments, hydrate and waxes may be melted off internal surfaces by the introduction of chemicals, such as methanol. Referring now to FIG. 2, yet another embodiment of a remediable system 200 for managing hydrates and hydrocarbon-based solids in a hydrocarbon stream is presented. As shown, production from an undersea production field 212 flows through flow line 214 to a separation facility 218, which may be configured to remove water via flow line 220 to a water injection facility 222. After separation, a flow containing hydrocarbons (in gaseous, liquid, suspended solid forms, or any combination thereof) and water passes through flow line 224 to the suction side 264 of pump 262. The discharge side 266 of pump 262 is fed to a first mechanism 227 for dividing the flow between inlet 231 of first cold flow reactor 230 and inlet 237 of a second cold flow reactor 236. In certain embodiments, the volume of flow sent to the first cold flow reactor 230 may range from 0 vol. % to 100 vol. %, and the volume of flow sent to the second cold flow reactor 236 may range from 100 vol. % to 0 vol. %.

In certain embodiments, the first mechanism 227 provides a lesser portion of the hydrocarbon stream to the first cold flow reactor 230 or the second cold flow reactor 236, the cold flow reactor receiving the lesser portion of the hydrocarbon stream placed in a remediation mode. In certain embodiments, the first mechanism 227 includes a first valve 226, and a second valve 228. As shown in FIG. 2, the first valve 226 and the second valve 228 are configured so that cold flow reactor 230 is on-line and receives a major portion (greater than 50 vol. %) of the flow, with cold flow reactor 236 placed off-line, receiving a minor portion (less than 50 vol. %) of the flow through flow line 234.

In certain embodiments, a second mechanism 241 is provided for placing outlet 233 or 239 of the cold flow reactor 230 or 236 (whichever is receiving the greater portion of the hydrocarbon stream) in fluid communication with the production flow of flow line 244. As shown, second mechanism 241 may include valves 242 and 256.

In operation, the flow to the on-line cold flow reactor 230 is emulsified by a static mixer 238 and cooled by a heat exchanger 240 of the cold flow reactor 230, to form a hydrate slurry (when water and gas are present), which is sent through flow line 232 and valve 242 of the second mechanism 241, to the production flow line 244.

Once again, the flow to the off-line cold flow reactor 236 may be choked or terminated at valve 226 and remediation measures implemented. As indicated above, accumulated hydrates and waxes may be melted off the internal surfaces of the static mixer 250 and heat exchanger 252 of the cold flow reactor 236 by the introduction of chemicals, such as methanol from a source of chemicals 270. The chemicals may be introduced to the off-line cold flow reactor 236 via flow line 272 and valve 274. As shown in FIG. 2, in some embodiments, the flow containing the remediation products exit cold flow reactor 236 through flow line 254 and may be mixed with the production flow of cold flow reactor 230 and sent downstream through production flow line 244.

As with the embodiments of FIGS. 1A and 1B, when the cold flow reactor 236 has been remediated, it can be switched over to on-line mode, and serve as the on-line reactor. Cold flow reactor 230 can then be configured to undergo remediation. These changes are accomplished by resetting of valves 226, 228, 242, 256, 272 and 278. The chemicals may be introduced to the off-line cold flow reactor 230 via flow line 276 and valve 278.

In an optional embodiment, the production flow from conduit 224 is first pre-cooled in heat exchanger 225 to a temperature above the wax formation temperature, so as to reduce heat loads on the heat exchangers 240 and 252 of the cold flow reactors 230 and 236. Alternatively, a pre-cooling heat exchanger can be placed in each cold flow reactor 230 and 236, prior to the flow encountering static mixer 238 and 250.

Referring to FIGS. 1A-2, in certain embodiments, the heat exchanger of the first cold flow reactor 30, 130 and 230, and the heat exchanger of the second cold flow reactor 36, 136 and 236, is designed and configured to cool the portion of the hydrocarbon stream directed thereto to a temperature less than the hydrate formation temperature, the temperature and residence time effective to substantially complete hydrate formation upon exiting the system 10, 100 and 200.

In certain embodiments, for each cold flow reactor 30, 130 and 230, and 36, 136 and 236, the static mixer 38, 138 and 238, and 50, 150 and 250, is positioned upstream of the heat exchanger 40, 140 and 240, and 52, 152 and 252, respectively, and in fluid communication therewith.

In certain embodiments, for each cold flow reactor 30, 130 and 230, and 36, 136 and 236, a second static mixer (not shown) is positioned downstream of the heat exchanger 40, 140 and 240, and 52, 152 and 252, respectively, and in fluid communication therewith.

In certain embodiments, for each cold flow reactor 30, 130 and 230, and 36, 136 and 236, the static mixer 38, 138 and 238, and 50, 150 and 250, is positioned downstream of the heat exchanger 40, 140 and 240, and 52, 152 and 252, respectively, and in fluid communication therewith.

Referring now to FIGS. 1A and 1B, in certain embodiments, each cold flow reactor 30 and 130, and 36 and 136 includes a heater (not shown) for remediation of hydrate or hydrocarbon-based solids. The heater may be in the form of heat tape that is wrapped around the external surfaces of the static mixers 38 and 138, and 50 and 150, and the heat exchangers 40, and 140, and 52 and 152.

In certain embodiments, any of the systems 10, 100, or 200 may further include a third cold flow reactor (not shown), the third cold flow reactor comprising an inlet for receiving at least a portion of the hydrocarbon stream, an outlet, a heat exchanger, and at least one static mixer, wherein the first mechanism 27, 127 and 227 is structured and arranged to provide a lesser portion of the hydrocarbon stream to the first cold flow reactor 30, 130 and 230, or the second cold flow reactor 36, 136 and 236, or the third cold flow reactor (not shown) and placing that cold flow reactor receiving the lesser portion of the hydrocarbon stream in a remediation mode.

In certain embodiments, the second mechanism 41 and 141 is structured and arranged to place the outlet of the cold flow reactor 33, 39, 133 or 139, which receives the lesser portion of the hydrocarbon stream in fluid communication with the suction side 64 and 164 of the pump 62 and 162.

As may be appreciated by those skilled in the art, the cold flow transport of production fluids through pipelines takes advantage of a state in which hydrocarbon gases (principally methane) and water present in the production fluid are depleted from the fluid phase and solidified into small particles (relative to the diameter of the pipeline) and slurried in the fluid flow. The slurry represents an equilibrium state under the conditions present in the pipeline flow, and so further formation of hydrates downstream from formation of the slurry is minimal. However, the non-equilibrium state encountered as the flow is cooled in a cold flow reactor that forms the slurry and collisions of the slurry particles with surfaces inside the cold flow reactor can result in the deposition of a film of hydrate, and often waxes and the like, onto the inside surfaces of a cold flow reactor. Eventually this film builds to a thickness that impedes flow through the cold flow reactor. The systems and methods disclosed provide a solution to this problem.

Depletion of water from the flow minimizes agglomeration of the slurry particles into a mass large enough to plug the pipe or otherwise impede flow. Also, maintaining a threshold transport velocity provides sufficient shear at the walls of the pipeline to prevent substantial accumulation of hydrate and waxes or minimize deposition of hydrate or waxes in the downstream pipe.

To further inhibit the accumulation of hydrates and waxes on the inner surfaces of a pipeline, pumps, reactors, mixers, valves and the like, various coatings, alloys and other materials may be employed, so that hydrate and/or wax deposition is minimized. Such coatings, alloys and other materials are described, for example, in U.S. Pat. No. 8,602,113, the contents of which are hereby incorporated for these details.

As used herein, an "inner surface" of a pipeline, valve, pump, mixer, cold flow reactor, etc., is that surface that comes into contact with a flow of production hydrocarbon fluids, or that come into contact with a flow of the hydrate slurry formed and transported in a cold flow process, when such are present.

As has been described, the systems and methods disclosed herein address the issues associated with the accumulation of hydrate and waxes by providing a system that includes at least two cold flow reactors that can be interchanged into a cold flow production line such that at least one cold flow reactor is operational to generate a hydrate/wax slurry in the pipeline, while at least one other cold flow reactor is taken out of the production stream for remediation of any buildup of hydrate and/or waxes on its inside surfaces.

In certain embodiments, the assembly comprising the static mixer(s) and heat exchanger(s) may be contained within a vessel.

In certain embodiments, the static mixer can be arranged before the heat exchanger in the path of the flow of a liquid through the cold flow reactor or vice-versa. In some embodiments, a static mixer is arranged before the heat exchanger in the liquid flow path and a second static mixer is arranged after the heat exchanger. In such an arrangement, larger hydrate particles and agglomerations of hydrate that form are reduced in size by fragmentation caused by shear in the second static mixer.

In certain embodiments of the cold flow reactor, the heat exchanger portion can comprise an uninsulated pipe exposed to an arctic or subsea environment. In such embodiments, the length of pipe serving as a heat exchanger should be sufficient to lower the temperature of the flow through the inlet end to below the equilibrium hydrate formation temperature by transfer of heat through the pipe to the environment over some desired range of flow rate.

In the embodiment of the cold flow reactor described above, the uninsulated pipe may contain one or more static mixers to agitate the flow as it cools to the hydrate formation equilibrium temperature. Alternatively, the section of uninsulated pipe serving as a heat exchanger can be followed by a further section of pipe that contains one or more static mixers for agitating the flow to produce a hydrate or wax slurry. Such following section of pipe containing static mixers can be insulated and/or provided with one or more heaters, so that the temperature of the flow through the static mixers is maintained near the equilibrium hydrate formation temperature.

In certain embodiments of the cold flow reactor, the flow path of the assembly of the heat exchanger and/or of the static mixer portions can be serpentine or coiled.

Static mixers useful herein and of various designs are available commercially from a number of manufacturers. For instance, the Koflo Corporation offers their Series 275 mixer in a variety of configurations up to 60" pipe diameter. Koflo Corporation also offers their Series 246 line (http://www.koflo.com/static-mixers/flanged-industrial-mixers.html) that is especially useful for mixing fluids of high viscosity and slurries. Sulzer offers their SMR™ "Mixer-Reactor" line and their SMXL™ (http://www.sulzer.com/en/Products-and-Services/Agitators-Mixers-and-Dispensers/Static-Mixers/Heat-Exchangers-and-Reactors) that are useful for simultaneous mixing and heat exchange in applications requiring mixing of viscous fluids.

In certain embodiments, a cold flow reactor may include at least one fluid delivery line delivering chemicals for producing a hydrate slurry (for example an emulsifier as described in U.S. Pat. No. 7,008,466, which is hereby incorporated by reference for that purpose), and/or for remediation of a hydrate and/or wax deposit on the inside surfaces of said cold flow reactor (for example, methanol), and/or at least one electrical connection for delivering energy, for instance as electricity or heat, for remediation of a hydrate and/or wax deposit on the walls of said cold flow reactor.

In certain embodiments, each cold flow reactor may include a heater for raising the temperature of the inside surfaces of said cold flow reactor. A heater can be combined with a chemical delivery line to provide two means for removing deposits from the inside surfaces of the cold flow reactor.

In certain embodiments of a production and pipeline system, the separator and other components of the system can be located subsea, e.g., on the sea floor.

In certain embodiments of a production and pipeline system, the system can be located in an arctic environment.

In certain embodiments, a subsea or arctic processing and pipeline system can further include a jumper from the separation plant that carries water from the subsea separation plant to a water injection facility.

Figure 3:
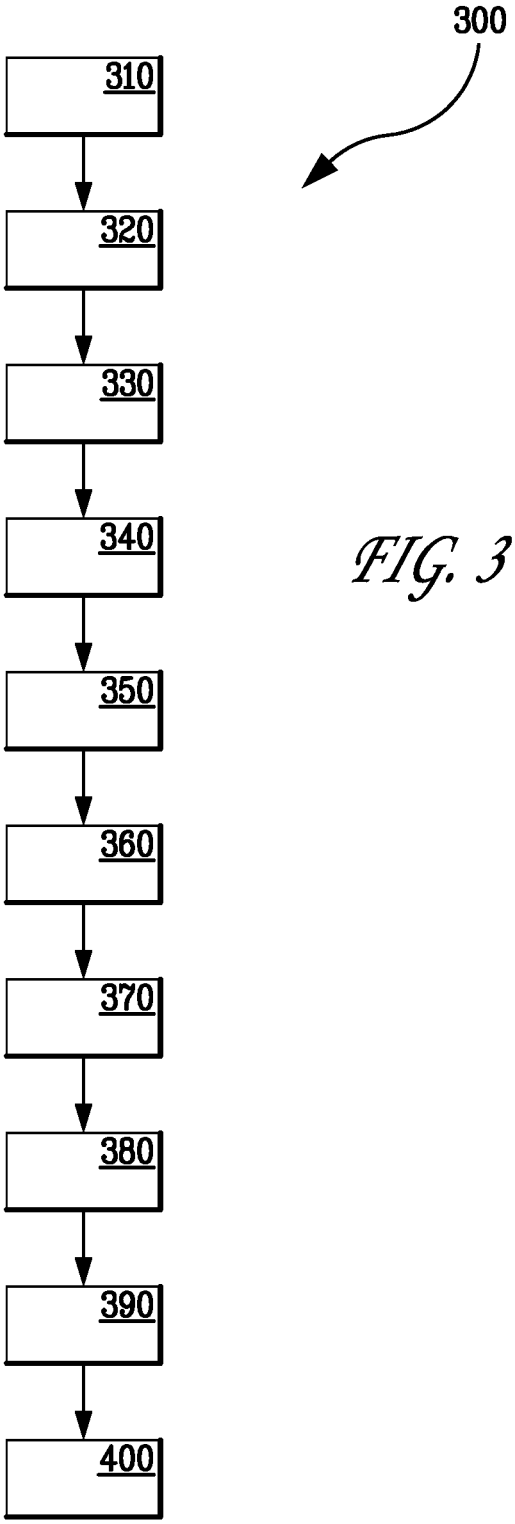
FIG. 3 presents a flowchart of a process for managing hydrates and hydrocarbon-based solids in a hydrocarbon stream, in accordance herewith.

Referring now to FIG. 3, provided is a process 300 for managing hydrates and hydrocarbon-based solids in a hydrocarbon stream. The process includes 310, introducing the hydrocarbon stream into an inlet of a system comprising at least a first cold flow reactor and a second cold flow reactor, each cold flow reactor comprising a heat exchanger and at least one static mixer; 320, directing at least a portion of the hydrocarbon stream to the first cold flow reactor; cooling the portion of the hydrocarbon stream directed to the first cold flow reactor to a temperature less than the hydrate formation temperature, the temperature effective to substantially complete hydrate formation upon exiting the system to form a hydrate and hydrocarbon-based solids managed hydrocarbon stream; 330, directing a lesser portion of the hydrocarbon stream to the second cold flow reactor; and 340, remediating the second cold flow reactor by removing hydrate or hydrocarbon-based solids formed on internal surfaces of the second cold flow reactor.

In certain embodiments, hydrate or hydrocarbon-based solids are removed by introducing chemicals into the lesser portion of the hydrocarbon stream.

In certain embodiments, hydrate or hydrocarbon-based solids are removed by heating the external surfaces of the second cold flow reactor.

In certain embodiments, the process further includes 350, forming a remediation slipstream comprising removed hydrate or hydrocarbon-based solids.

In certain embodiments, the process further includes 360, returning the remediation slipstream to the inlet of the system.

In certain embodiments, the process further includes 370, subsequently directing at least a portion of the hydrocarbon stream to the second cold flow reactor; 380, cooling the portion of the hydrocarbon stream directed to the second cold flow reactor to a temperature less than the hydrate formation temperature, the temperature effective to substantially complete hydrate formation upon exiting the system to form a hydrate and hydrocarbon-based solids managed hydrocarbon stream; 390, directing a lesser portion of the hydrocarbon stream to the first cold flow reactor; and 400, remediating the first cold flow reactor by removing hydrate or hydrocarbon-based solids formed on internal surfaces of the first cold flow reactor.

In certain embodiments of the process disclosed herein, the production flow is first pre-cooled to a temperature above the wax formation temperature, for example 5 to 20° C. above this temperature, so as to reduce heat loads on the heat exchangers within the cold flow generators. In such an instance, the pre-cooling is performed in a heat exchanger that can be placed along the flow path prior to the inlet manifold of a cold flow reactor. Alternatively, a pre-cooling heat exchanger can be placed in each cold flow reactor prior to the flow encountering a first static mixer or a first heat exchanger.

In certain embodiments of the process disclosed herein, the static mixer and the heat exchanger can be arranged together within a vessel having an inlet side and an outlet side that confines the flow path.

As may be appreciated, the state of the cold flow reactors as on-line or off-line can be switched as desired, e.g., when any deposits of hydrate and/or wax in the off-line reactor have been sufficiently remediated, so as to provide for continuous flow in the production flow line.

In certain embodiments of the cold flow reactor disclosed herein, and in any embodiment of the cold flowing methods disclosed herein, a return flow jumper may be provided connecting the outlet of a cold flow generator to the input of a separation plant (which may be located on a seafloor, on a floating platform, or on land) or to the inlet manifold of the cold flow reactor or to the inlet of a cold flow generator part of such cold flow reactor. In subsea applications the return flow jumper may be connected at a subsea separator, ahead of the suction of an inline pump for moving fluids along the production flow line. Alternatively, a dedicated pump can be used for recirculating fluids through the return flow jumper.

In configurations of the cold flow reactor in which a return flow jumper is present, a valve may be present at the outlet side of each cold flow generator that controls flow between the outlet manifold connecting to the production flow line and the return flow jumper.

In certain embodiments, the production flow may be split such that some of the flow is directed to a cold flow reactor, so that small hydrate particles are formed in the reactor outside the main flow. Hydrate formation in such a side flow serves to deplete water and gas from the main production flow, as described in U.S. Pat. No. 7,008,466, hereby incorporated by reference for this purpose. Then the two flows are rejoined downstream from the hydrate formation section comprising the cold flow reactor.

In certain embodiments, a flow containing small hydrate particles formed in a cold flow generator may be recirculated back to the production flow, thereby providing "seed particles" that serve as nuclei for further growth of hydrate particles. Such a flow of hydrate seed particles can be introduced into the production flow before, or as, the main production flow encounters a cold flow reactor. Without being bound by any theory, in such a case, the generation of numerous nuclei promotes the growth of a large number of small hydrate particles suitable for transport through a pipeline without plugging, rather than formation of a smaller number of larger hydrate particles that may be of such size as to plug the pipeline.

In certain processes disclosed herein, the temperature of the hydrocarbon production stream may be lowered to 4 to 12° C. over a time from 5 to 1200 minutes.

In certain embodiments of the processes disclosed herein, the hydrocarbon production stream comprises 0 to 99 vol. % water, or 0 to 15 vol. % water, or to 0 to 5 vol. % water.

In certain embodiments, the gas fraction of the hydrocarbon production stream may be between 0 to about 50 vol. %, or about 15 to about 25 vol. %.

Figure 4:
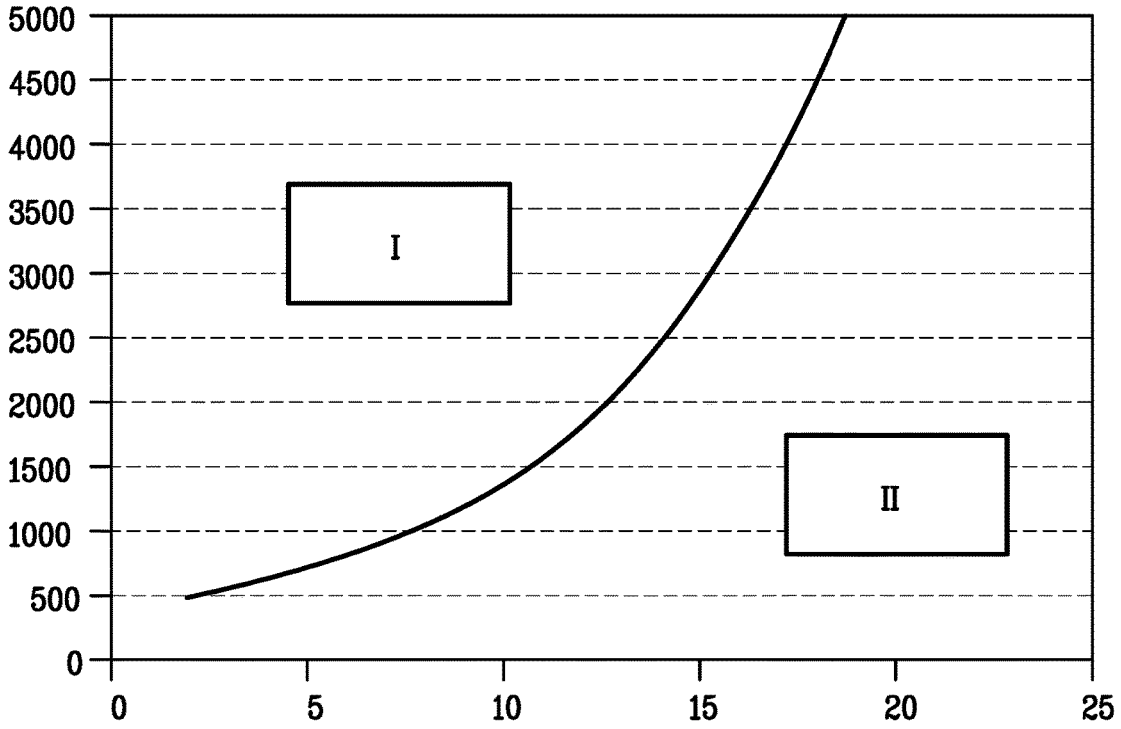
FIG. 4 presents a representative phase diagram for hydrate formation.

The equilibrium temperature for hydrate formation is a function of composition of the hydrocarbon production fluid, especially of the water and gas proportions, and pressure. The equilibrium temperature for hydrate formation is determinable from a phase diagram, as is known in the art. An exemplary phase diagram for a hydrocarbon production fluid of 10% watercut, 30% gas void volume fraction is presented in FIG. 4. In FIG. 4, the horizontal axis represents temperature, in degrees Celsius, and the vertical axis represents pressure, in psia. The phase regime in which hydrates are thermodynamically stable is identified as "I," and the phase regime where a mixture of gas and water is thermodynamically stable is identified as "II." The hydrate formation equilibrium temperature is typically from about 8 to about 12° C., or about 10° C., at pressures of about 700 to about 1500 psia (about 45 barg to about 105 barg or about 4.5 MPa to about 10.5 MPa) or about 1000 to about 1200 psia (about 65 barg to about 85 barg or about 6.5 MPa to about 8.5 MPa).

In certain embodiments disclosed herein, the temperature of the hydrocarbon production stream is lowered to the ambient temperature of the environment surrounding the pipeline, typically −4 to 6° C., more typically 2 to 6° C., or 3 to 5° C., over a time up to that required for the flow to traverse 2 to 5 kilometers of the pipeline. In some embodiments, however, the production flow is typically chilled to a temperature of 2 to 6° C. over a flow of less than 1 kilometer, or over a flow of less than 0.5 kilometer, or over a flow of less than 0.25 kilometer, and/or over a flow of 100 meters or less depending on water content of the fluids from the separation system. However, in some embodiments, the flow is chilled to ambient temperature over a short distance and quickly, that is, within 5 to 15 or within 5 to 10 minutes. A cooling time in accordance herewith, is typically from 5 to 1200 minutes, or from 5 to 600 minutes, or from 5 to 60 minutes.

In general then, the production flow should typically encounter a cold flow reactor within about 1 kilometer, or some distance between 250 and 500 meters, from its source at the wellhead, and within 5 to 10 minutes of flow time.

The size of hydrate particles that form is also influenced by overall flow rate through the system, with higher flow rates tending to reduce particle size and agglomeration. Hydrocarbon production flow will typically be at a rate from 1.0 to 3.0 meters per second (m/s), or from 1.2 to 2.5 m/s, through the system.

In certain embodiments of the cold flow method disclosed herein, the hydrate and/or wax or paraffins form particles having a mean diameter of up to 1 millimeter, more typically less than 250 microns, and/or 50 microns or less. In certain embodiments, "dry" hydrate particles that are not susceptible to further agglomeration are formed.

A feature of the cold flow transport method disclosed herein is that it provides for continuous flow of the production fluids from the cold flow reactors to downstream production facilities. "Continuous flow" is considered to be flow that includes pauses of no longer than 1 hour, or no longer than 45 minutes, or no longer than 30 minutes, or no longer than 15 minutes, or without pause. Such continuous flow is provided by switching the hydrocarbon production stream between the on-line and off-line reactors during the cold flow transport process. In some embodiments, the flow through the off-line cold flow reactor can be slowed greatly, for example to a rate of 0.01 to 0.2 m/s or from 0.05 to 0.1 m/s, but not completely stopped.

In certain embodiments, a pipeline downstream from the cold flow reactor is at least 150 kilometers long. However, such a pipeline can be at least 100 kilometers long or between 50 and 100 kilometers long, and may be as short as 5 or 10 kilometers long.

In general, the methods and systems disclosed herein finds use in subsea or arctic production of hydrocarbon fluids and may be used together with a subsea or arctic separation system that removes a substantial amount of water from the hydrocarbon stream prior to its introduction into the cold flow reactor.

One set of operational field conditions useful for design of a system in accordance herewith includes:

- Water liquid flow rate: 0 barrels per day (bpd) to 35000 bpd
- Water cut: 0-100 vol. % (or 0-5 vol. %)
- Gas flow rate: 0 to 100 MMSCFD (million standard cubic foot/day) (or 0 to 3 million cubic meters per day)
- Oil flow rate: 4000 to 82000 bpd
- Inlet P: 45 barg (or 4.5 MPa)
- Inlet T: 25-80° C.
- Cool to ~4° C. (ambient temperature): over a pipeline flow of 2-5 kilometers US Patent Publication No. US 2009/0078406A1, corresponding to WO 2007/095399, describes several working parameters and their effects on size of water droplets in the flow and upon the size of hydrate particles formed, as well as the process and apparatus for providing a seeding flow input. These patent publications are hereby incorporated by reference for these purposes.

The embodiments disclosed herein, as illustratively described and exemplified hereinabove, have several beneficial and advantageous aspects, characteristics, and features. The embodiments disclosed herein successfully address and overcome shortcomings and limitations, and widen the scope, of currently known teachings with respect to cold flow transport of a hydrocarbon stream.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The apparatus and methods disclosed herein are applicable in the oil and gas industry.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A process for managing hydrates and hydrocarbon-based solids in a hydrocarbon stream, the process comprising:

(a) introducing the hydrocarbon stream into an inlet of a system comprising at least a first cold flow reactor and a second cold flow reactor, each cold flow reactor comprising a heat exchanger and at least one static mixer;

(b) directing at least a portion of the hydrocarbon stream to the first cold flow reactor;

(c) cooling the portion of the hydrocarbon stream directed to the first cold flow reactor to a temperature less than the hydrate formation temperature to form a hydrate and hydrocarbon-based solids managed hydrocarbon slurry stream;

(d) directing a lesser portion of the hydrocarbon stream to the second cold flow reactor;

(e) remediating the second cold flow reactor by removing hydrate or hydrocarbon-based solids formed on internal surfaces of the second cold flow reactor;

(f) forming a remediation slipstream comprising removed hydrate or hydrocarbon-based solids from the second cold flow reactor; and (g) returning the remediation slipstream from the second cold flow reactor to the inlet of the system.

2. The process of claim 1, wherein hydrate or hydrocarbon-based solids are removed by introducing methanol into the lesser portion of the hydrocarbon stream.

3. The process of claim 2, wherein hydrate or hydrocarbon-based solids are removed by heating the external surfaces of the second cold flow reactor.

4. The process of claim 1, wherein hydrate or hydrocarbon-based solids are removed by heating the external surfaces of the second cold flow reactor.

5. The process of claim 1, further comprising:

(h) after the remediating (e), directing at least a subsequent portion of the hydrocarbon stream to the second cold flow reactor;

(i) cooling the subsequent portion of the hydrocarbon stream directed to the second cold flow reactor to a temperature less than the hydrate formation temperature to form a hydrate and hydrocarbon-based solids managed hydrocarbon slurry stream;

(j) directing a subsequent lesser portion of the hydrocarbon stream to the first cold flow reactor; and (k) remediating the first cold flow reactor by removing hydrate or hydrocarbon-based solids formed on internal surfaces of the first cold flow reactor.

6. The process of claim 5, further comprising (l) forming a subsequent remediation slipstream comprising removed hydrate or hydrocarbon-based solids from the first cold flow reactor.

7. The process of claim 6, further comprising (m) returning the subsequent remediation slipstream from the first cold flow reactor to the inlet of the system.

* * * * *